US009476214B2

(12) United States Patent
Parks et al.

(10) Patent No.: US 9,476,214 B2
(45) Date of Patent: Oct. 25, 2016

(54) REMOVABLE POOL SKIMMER PLUG

(76) Inventors: Mark Parks, Pinon Hills, CA (US); Garasich John, Rancho Cucamonga, CA (US)

( * ) Notice: Subject to any disclaimer, the term of this patent is extended or adjusted under 35 U.S.C. 154(b) by 0 days.

(21) Appl. No.: 12/655,228

(22) Filed: Dec. 26, 2009

(65) Prior Publication Data

US 2011/0154565 A1 Jun. 30, 2011

(51) Int. Cl.
*E04H 4/14* (2006.01)
*E04H 4/12* (2006.01)

(52) U.S. Cl.
CPC ..... *E04H 4/1272* (2013.01); *E04H 4/14* (2013.01)

(58) Field of Classification Search
CPC ..... E04H 4/1272
USPC ..... 4/496, 507, 508, 510; 210/167.1, 210/167.18, 416.2, 167.19
See application file for complete search history.

(56) References Cited

U.S. PATENT DOCUMENTS 3,239,149 A * 3/1966 Lindberg, Jr. ..... 239/203
3,552,567 A * 1/1971 Arp ..... 210/167.1
3,567,020 A * 3/1971 Whitaker et al. ..... 210/94
4,154,679 A * 5/1979 Farage ..... 210/121
4,185,333 A * 1/1980 Ortega ..... 4/489
4,348,281 A 9/1982 Perry et al.
4,629,557 A * 12/1986 Tobias ..... 210/90
4,776,908 A * 10/1988 Sapp ..... 156/94
4,798,670 A * 1/1989 Treene ..... 210/167.1
4,879,772 A * 11/1989 Meloney, Jr. ..... 4/506
4,903,351 A 2/1990 Dengel et al.
5,038,949 A * 8/1991 Mahon ..... 215/386
5,259,076 A 11/1993 Voight et al.
5,392,472 A 2/1995 Maxfield
5,510,020 A 4/1996 Gronlund
5,604,939 A 2/1997 Widener
5,605,622 A * 2/1997 Ferraro ..... 210/167.12
5,706,530 A * 1/1998 Mariano ..... 4/496
5,799,343 A * 9/1998 Semco et al. ..... 4/504
6,578,208 B1 * 6/2003 Lytle ..... 4/507
6,868,562 B2 * 3/2005 Arp et al. ..... 4/496
6,966,078 B2 11/2005 Evans et al.
7,413,651 B2 * 8/2008 Hodak ..... 210/167.19
7,815,795 B2 * 10/2010 Parks et al. ..... 210/167.1
2006/0059615 A1 * 3/2006 Beaton ..... 4/507

* cited by examiner

*Primary Examiner* — Janie Christiansen

(57) ABSTRACT

This application describes a device to convert an existing pool skimmer assembly into a pressurizable pool skimmer assembly which allows the existing pool skimmer assembly to act with this existing pool pump in emergency situations, such as assisting firefighters with pool water for extinguishing local wildfires or house fires. This method utilizes a removable plug cap and o-rings to allow the pool pump to draw the pool water from the poolmaid drain using the existing pool skimmer. This device can also be used to drain the pool for cleaning the pool or for winterizing the pool, with out the need for an electrical sump pump.

13 Claims, 3 Drawing Sheets

REMOVABLE POOL SKIMMER PLUG

BACKGROUND OF THE INVENTION

1. Field of the Invention

The present invention relates to the field of closure assemblies that are used in the pool industries. The closure assemblies have generally been used for pool maintenance and closing the swimming pool skimmer for winter (winterizing).

The field of endeavor for this invention is directed towards in-ground pools and above ground pools that have a skimmer attached to the pool and the pump.

2. Description of the Prior Art

U.S. Pat. No. 4,281,422 by Simonelli discloses a winterizing kit that includes a socket plug that fits into a female receptacle of a filtered water inlet. The socket plug includes a check valve and a nipple to impede the flow of water from the swimming pool and also disconnect an air compressor attached to the pool water line. This invention is not anticipated to be used in a skimmer, but specifically placed into the inlet/outlets in the wall of a pool.

U.S. Pat. No. 4,825,605 by Weir discloses a closure device for pre-formed wall openings in swimming pool side wall panels that includes the insertion of either rectangular or circular-shaped plugs into the wall openings. The plugs are used to close unwanted openings in the wall of the swimming pool. The plugs are attached to the side wall of the pool.

U.S. Pat. No. 4,903,351 by Dengel et al. discloses a winterizing faceplate kit for the side wall of the swimming pool. The kit includes a cover plate, faceplate, and a pair of gaskets, where the cover plate is adapted to be removable and to be secured to the sidewall, thus facilitating spring season opening and fall season closure of the swimming pool U.S. Pat. No. 4,285,358 by Hodak discloses a sealing assembly similar to U.S. Pat. No. 4,903,351 by Dengel and includes a gasket frame, faceplate and a cover panel which are all attachable to the inside surface of a pool wall in order to shut the water flow from the pool to the skimmer.

What is needed and has never been disclosed or described in the prior art is an apparatus for pools that have been completed and will allow the skimmer to be sealed from the side drain of the pool, but still allow communication between the pool pump and the main drain through the fittings that are attached at the bottom of the skimmer.

SUMMARY OF THE INVENTION

The present invention discloses a conventional swimming pool skimmer that is known in the art for many years and has been adapted to receive a removable pool skimmer plug. The removable pool skimmer plug has been designed and adapted to be inserted into the bottom portion of the skimmer that has already been installed in a pool. The removable pool skimmer plug is located below the side drain inlet for the pool or throat.

The removable pool skimmer plug will have at least one O-Ring or gasket that will provide a vacuum seal to allow the pump to more easily draw water from the main drain of the pool. Since the swimming pool skimmer housing has already been installed, and may be several years old, the removable pool skimmer plug has been designed to provide a vacuum seal to eliminate the pump from drawing water from the throat of the skimmer, which is located on the side wall of the pool.

The removable pool skimmer plug will be inserted near the bottom of the swimming pool housing on a flange of the pool skimmer body, but still provide a gap to allow water from the main drain port to maintain a constant fluid communication with the port to the pump system.

It is therefore a primary object of the invention to provide a removable pool skimmer plug that can be used in skimmers that have already been installed into pools, or for existing unmodified skimmers to pump water from these pools to assist in extinguishing fires by using the pool water in those states that are prone to wildfires such as in California, and Florida.

It is therefore an object of the invention to provide a simple device for previously installed pool systems to provide an easily removable pool skimmer plug for the swimming pool skimmer that will allow the main drain to be in direct fluid communication with the pump system.

A second object of the invention is that the insertion of the plug into the skimmer will prevent the pump from burnout when the water level drops below the skimmer level.

Another object of the invention is that when there is a freeze, specifically in the midwest and northern states, it will still be possible to drain water from the main drain, even if there is ice covering the skimmer.

Another object of the invention, is the elimination of the requirement for a sump pump to drain the pool, which also implies that there are no electrical connections near the pool water site.

Another object of the invention is to assist in winterizing the pool by inserting the plug into the skimmer and draining the pool water.

DETAILED DESCRIPTION

Figures 1, 2:
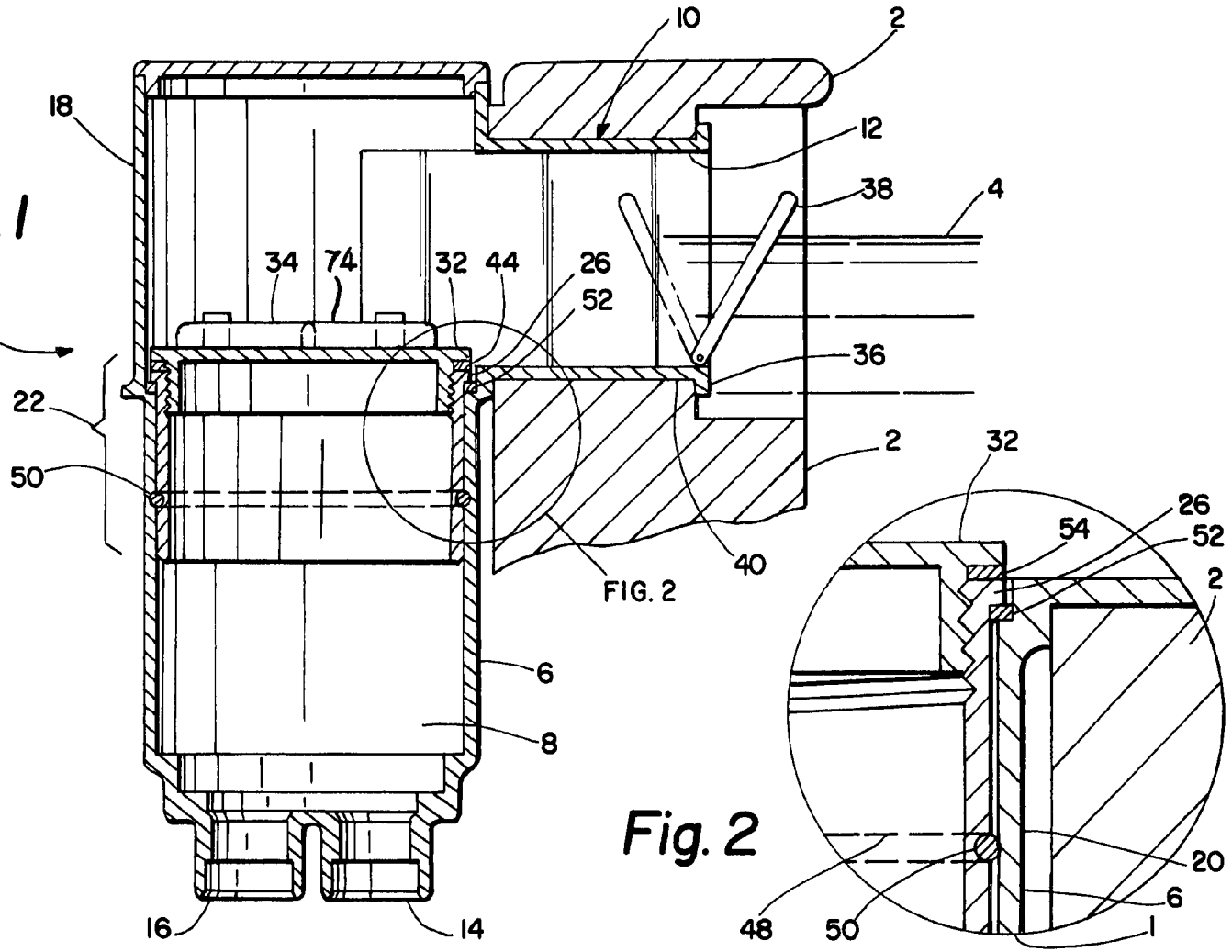
FIG. 1 shows a cross section of the pool skimmer attached to an inground pool.
FIG. 2 shows a detailed view of the cap, plug body and pool skimmer.

FIG. one (1) shows an environmental view of an industry standard pool skimmer (1). The pool skimmer (1) is common within the industry of swimming pools, and differs in generic shapes between the various manufacturers of pool skimmers, based upon the manufacturer's specific design criteria. The pool skimmer (1) is shown imbedded in the side of a pool (2), where the water line (4) is shown, depicting the water level, which allows the water to flow into the pool skimmer (1) and hence be drawn into the pump system. The pool skimmer (1) is comprised of a body (6), where the body (6) may be composed of multiple components either solvent welded or glued together. The body (6) of the pool skimmer has a centrally located hollow portion (8). The body also has a throat (10) attached thereon, where the throat (10) projects outward from the body (6) and provides a direct conduit from the pool (2) to the hollow portion (8) of the pool skimmer (1). The throat (10) has a large central through opening or mouth (12) that allows the water in the pool (2) and communicates with the hollow portion (8) of the body (6).

The body (6) has an upper portion (40). The pool skimmer (1) is provided with a lock down lid or cap (42). The cap (42)

is generally lightly press fit, with a light snap to secure the cap (42) from easily being dislodged from the upper portion (40) of the pool skimmer (1).

As can be seen in FIG. 1, the pool skimmer (1) comprises an upper portion (18) and a lower portion (20). The upper portion (18) comprises the throat (10). As is common in the pool skimmer industry, the throat (10) has a front portion (36), where the front portion (36) of the throat (10) has a weir (38). The weir (38) is pivotably mounted to a lower portion (40) and biased towards the front portion (36) of the throat (10). The weir (38) has positive buoyancy, and prevents debris from migrating from the pool skimmer (1) back into the pool (2).

The lower portion (20) of the pool skimmer (1), has, co-located at the bottom of the pool skimmer (1), a pool drain inlet (14) and a pump outlet (16). The pool drain inlet (14) and pump outlet (16) are internally sized to accept pvc (poly-vinyl chloride) piping, which is common in the pool and garden industry. An additional feature is to externally size the diameter of the pool drain inlet (14) and pump outlet (16) for larger piping, such as 3.0" pvc pipes. The reason for using larger diameter piping is that the newer pumps need a larger diameter pipe to provide increased efficiency, due to the higher pump flows generated. As is commonly done in the pool industry, the pipes that are either internally or externally attached would be fusion welded or glued into place.

Figure 3:
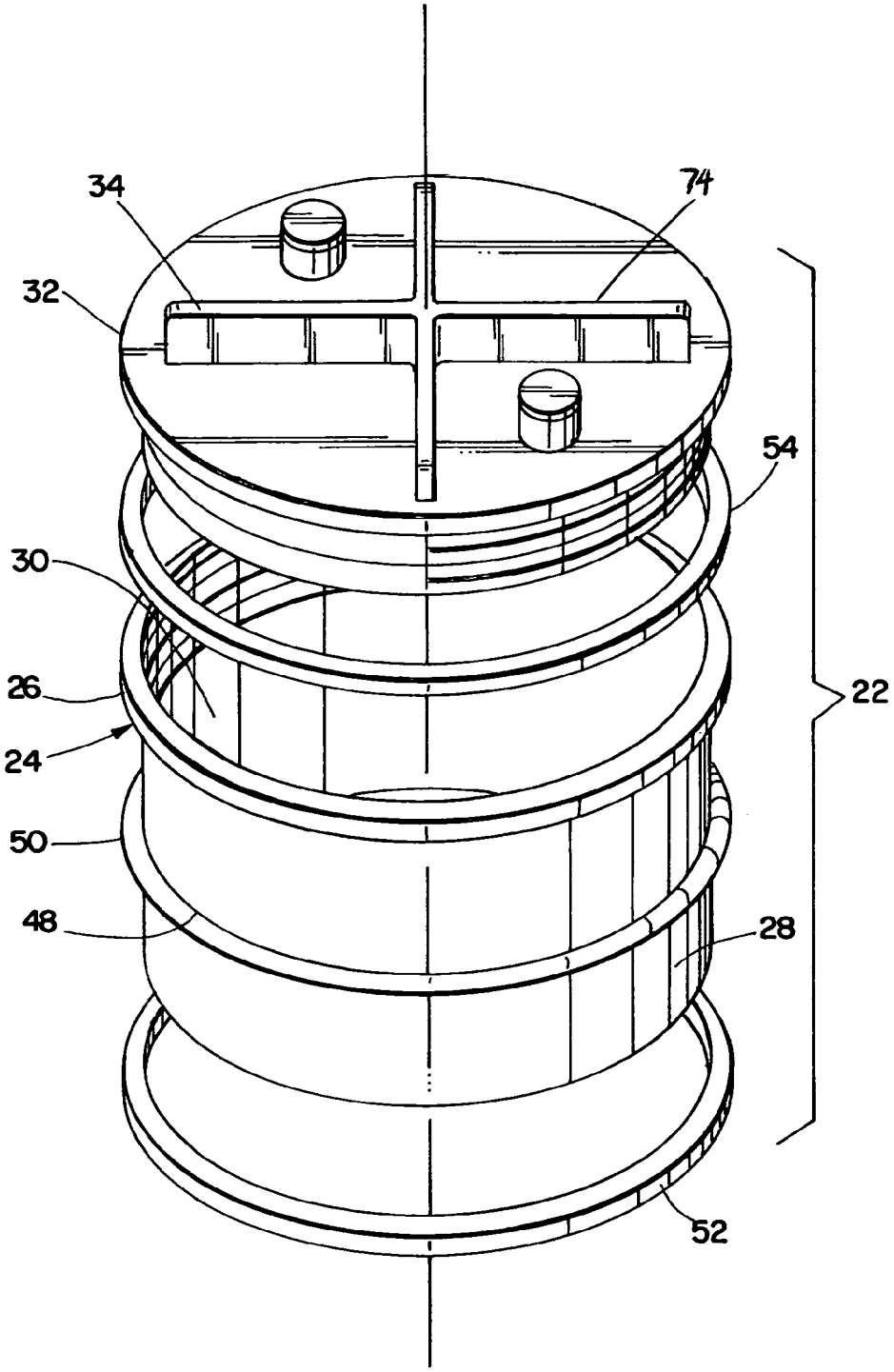
FIG. 3 shows an exploded perspective of the plug assembly.

FIGS. 1, 2, and 3 show that the pool skimmer (1) is provided with a removable pool skimmer plug (22). The removable pool skimmer plug (22) comprises a plug cap (32) and a plug body (28). As is common in the industry, the plug body (28) may be tapered, or may be cylindrically shaped. The plug body (28) has an upper portion (24), wherein the upper portion (24) of the plug body (28) has a continuous outwardly extended flange or ledge (26). The ledge (26) rests upon a correspondingly shaped shoulder (44) placed towards the lower portion (20) of the pool skimmer (1). The plug body (28) has an internally defined through hole (30), where the through hole (30) has means to secure a plug cap (32). Generally the means to secure the plug cap (32) would be by threadably attaching the plug cap (32) to the plug body (28), or by providing a pin and groove system common in many industries, to secure the plug cap (32) to the plug body (28).

The plug cap (32) has at least one raised boss (34). The raised boss(s) (34) provides a grip surface to the plug cap (32) and allows a user to easily install or remove the plug cap (32) from the pool removable pool skimmer plug (22). The plug body (28) has an outer surface (46). The outer surface (46) of the plug body (28) has a groove (48) defined therein. The groove (48) allows an o-ring (50) to be placed therein. The o-ring (50) may be adhesively positioned into the groove (48) preventing dislocation of the o-ring (50) when the removable pool skimmer plug (22) is placed into the pool skimmer (1).

As depicted in FIG. 2, the plug assembly may be provided with a gasket (52), the gasket (52) being placed between the ledge (26) of the plug body (28) and the shoulder (44) of the pool skimmer (1). A second gasket (54) may be provided and be placed between the ledge (26) of the plug body (28) and the cap (26).

As shown in FIG. 3, the cap (26) may be adapted to receive at least one poppet valve (56). The poppet valve will be used to alleviate any vacuum developed during the plug assemblies (22) use.

The external construction of the pool skimmer (1) is generally defined by the specific company fabricating the pool skimmer (1). They attempt to provide improved fixity to the gunnite or concrete by creating some form of ribbing that aids in adhesion. This invention does not revise the external ribbing of the original pool skimmer (1).

Figure 4:
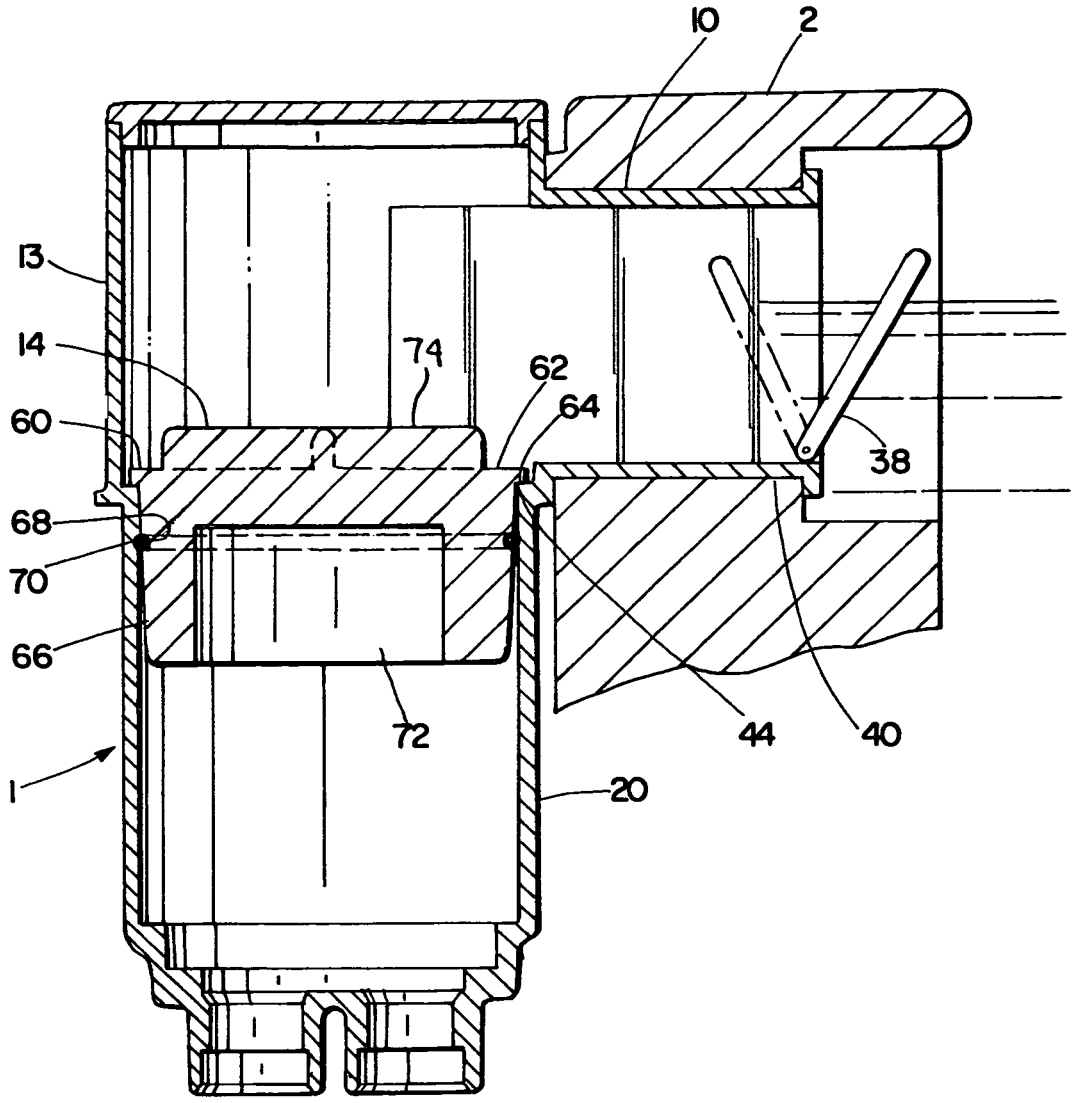
FIG. 4 shows an alternative removable pool skimmer plug.

FIG. 4 shows an alternative construction of the removable pool skimmer plug (60). The removable pool skimmer plug (60) has an upper cap portion (62) where the cap portion (62) may have an external ledge (64). The external ledge (64) would rest upon the shoulder (44) placed towards the lower portion (20) of the pool skimmer (1). The upper cap portion (62) has a downward protruding boss (66), where the downward protruding boss (66) extends into the lower portion (20) of the pool skimmer (1) and may have a light friction fit to provide an air tight seal when under vacuum. The downward protruding boss (66) may have a groove (68) defined therein, the groove (68) being adapted to seat an o-ring (70) between the downward protruding boss (66) and the lower portion (20) of the pool skimmer (1). The downward protruding boss (66) can be designed with a centrally positioned hollow portion (72). The upper cap portion (62) has a grip means (74), where the grip means (74) can have a variety of shapes to suit the manufacturer. Such shapes may be cruciform, a singular straight bar, a metallic handle or stirrup to be gripped by a users hand, etc.

This removable pool skimmer plug (60) operates as follows. The user places the downward protruding boss (64) into the lower portion (20) of the pool skimmer (1). The downward protruding boss (64) is sized to provide a light friction fit to the pool skimmer (1), while the upper cap portion (62) will rest upon the shoulder (44) of the pool skimmer (1). Vacuum from the pool pump will draw the removable pool skimmer plug (60) so that an air tight seal will be formed providing the pump with the maximum available suction to draw water from the main drain of the pool (2).

If no external ledge (64) is used in the design, upper cap portion (62) of the removable pool skimmer plug (60) would have a tapered downward protruding boss (66) and frictionally fit in the pool skimmer (1). When the pool pump is in operation, vacuum will draw the removable pool skimmer plug (60) tighter in the pool skimmer (1) making a tight seal. At least one o-ring (70) is used in the removable pool skimmer plug (60) design. If necessary the downward protruding boss (66) may have a groove (68) defined therein for each o-ring (70). As defined previously, the downward protruding boss (66) can be designed with a centrally positioned hollow portion (72). The upper cap portion (62) has a grip means (74), where the grip means (74) can have a variety of shapes to suit the manufacturer. Such shapes may be cruciform, a singular straight bar, a metallic handle or stirrup to be gripped by a users hand, etc.

Although the foregoing includes a description of the best mode contemplated for carrying out the invention, various modifications are contemplated.

As various modifications could be made in the constructions herein described and illustrated without departing from the scope of the invention, it is intended that all matter contained in the foregoing description or shown in the accompanying drawings shall be interpreted as illustrative rather than limiting.

What is claimed is:

1. A removable plug for removing water from a swimming pool having a 2-port skimmer comprising a tubular member having an internally defined through-hole, said member having a plug body and a plug cap, said plug body having at least one cylindrical portion that forms said plug body, said cylindrical portion configured to mate with a pool skimmer body and having an upper cylindrical portion threadably disposed to receive said plug cap and a lower cylindrical portion to be positioned to face downward, said plug cap having threads for threadably attaching to said plug body and closing said internally defined throughhole of said tubular member, whereby when said plug is installed by placing it into a hollow bottom portion of said pool skimmer body with said lower cylindrical portion facing downward, there is created a friction fit that provides an air tight seal thereby creating a chamber through which when a remotely located pool pump is engaged, pool water can be drawn from a pool drain located near the bottom of the pool, through a first port connected to the pool drain and a second port coupled to the remotely located pool pump, and whereby said pool water is drawn from the bottom of the pool to the remotely located pool pump and discharged for utilitarian purposes including but not limited to extinguishing fires, performing pool maintenance, gardening, and automobile washing.

2. A removable plug for a pool 2-port skimmer as claimed in claim 1, further comprising a hand grip on said plug cap for allowing a user to easily install or remove said plug cap.

3. A removable plug for a pool 2-port pool skimmer as claimed in claim 1, further comprising a gasket around said cylindrical portion for facilitating said air tight seal.

4. A removal plug for a pool 2-port pool skimmer as claimed in claim 1, further comprising an O-ring gasket around said cylindrical portion for facilitating said airtight seal.

5. A removable plug for removing water from a swimming pool having a 2-port skimmer comprising a tubular member having an internally defined throughhole, said member having a plug body and a plug cap, said plug body having at least one cylindrical portion that forms said plug body, said cylindrical portion configured to mate with a pool skimmer body and having an upper cylindrical portion threadably disposed to receive said plug cap and a lower cylindrical portion to be positioned to face downward, said plug cap having a means for attaching to said plug body and closing said internally defined throughhole of said tubular member, whereby when said plug is installed by placing it into a hollow bottom portion of said pool skimmer body with said lower cylindrical portion facing downward, there is created a friction fit that provides an air tight seal thereby creating a chamber through which when a remotely located pool pump is engaged, pool water can be drawn from a pool drain located near the bottom of the pool, through a first port connected to the pool drain and a second port coupled to the remotely located pool pump, whereby said pool water is drawn from the bottom of the pool to the remotely located pool pump and discharged for utilitarian purposes including but not limited to extinguishing fires, performing pool maintenance, gardening, and automobile washing.

6. A removable plug for a pool skimmer as claimed in claim 5, wherein said means for receiving said plug cap by said plug body is threads.

7. A removal plug for a pool skimmer as claimed in claim 6 wherein said means for attaching said plug cap to said plug body is threads.

8. A revocable plug for a pool skimmer as claimed in claim 5, further comprising a means for allowing a user to easily install or remove said plug cap.

9. A removable plug for a pool skimmer as claimed in claim 5, further comprising a means for allowing a user to easily install or remove said plug cap.

10. A removable plug for removing water from a swimming pool having a 2-port skimmer comprising a tubular member having an internally defined throughhole, said member having a plug body and a plug cap, said plug body having at least one cylindrical portion that forms said plug body, said cylindrical portion having an upper cylindrical portion having a means to receive said plug cap and a lower cylindrical portion, said upper cylindrical portion having a ledge for mating against a ledge of a skimmer lower portion, said plug cap having a means for attaching to said plug body and closing said internally defined throughhole of said tubular member, whereby when said plug is installed by placing it into a hollow bottom portion of said pool skimmer body with said lower cylindrical portion facing downward, there is created a friction fit that provides an air tight seal thereby creating a chamber through which when a remotely located pool pump is engaged, pool water can be drawn from a pool drain located near the bottom of the pool, through a first port connected to the pool drain and a second port coupled to the remotely located pool pump, whereby said pool water is drawn from the bottom of the pool to a remotely located pool pump and discharged for utilitarian purposes including but not limited to extinguishing fires, performing pool maintenance, gardening, and automobile washing.

11. A method for safely delivering a rapid supply of water from a swimming pool having a 2-port skimmer pool comprising:

(a) placing a tubular member into a pool skimmer lower portion, said tubular member having an internally defined throughhole, said member having a plug body and a plug cap, said plug body having at least one cylindrical portion that forms said plug body, said cylindrical portion configured to mate with a pool skimmer lower portion, said cylindrical portion having an upper cylindrical portion threadably disposed and receiving said plug cap, said internally defined throughole of said tubular member closed by said plug cap, and a lower cylindrical portion positioned to facing downward, (b) terminating pool skimmer by causing said tubular member to create a friction that provides an air tight seal for drawing the pool water from a pool drain located near the bottom of the pool, (c) creating a path through said skimmer lower portion for drawing pool water from said pool drain through a pool pump, (d) engaging said pool pump to draw water through path from said pool drain and through said pump outlet, (e) draining a quantity of water from a pool having said pool by running said pump to draw water through said path and discharging said pool water for utilitarian purposes including but not limited to extinguishing fires, performing pool maintenance, gardening, and automobile washing;

(d) disengaging said pool pump when said quantity of water is removed.

12. The method claimed in claim 11 further comprising removing said plug cap by threadably disengaging said pool cap from said pool body, thereby permitting said water to flow through said hollow plug body to reestablish pool skimmer function without removal of the entire tubular member.

13. The method claimed in claim 11 further comprising of attaching a predetermined length of hose to said pool pump and discharging pool water through said hose.

* * * * *